US008827373B2

(12) United States Patent
MacNeil et al.

(10) Patent No.: US 8,827,373 B2
(45) Date of Patent: Sep. 9, 2014

(54) TOP-DOWN HYDRO-DEMOLITION SYSTEM WITH RIGID SUPPORT FRAME

(75) Inventors: Gerard J. MacNeil, Surrey (CA); Gordon W. MacNeil, Delta (CA); David B. MacNeil, Langley (CA); Edward Van Gool, Surrey (CA); Vernon G. Bose, Langley (CA)

(73) Assignee: Mac & Mac Hydrodemolition Inc., Surrey, BC (CA)

( * ) Notice: Subject to any disclaimer, the term of this patent is extended or adjusted under 35 U.S.C. 154(b) by 284 days.

(21) Appl. No.: 13/019,712

(22) Filed: Feb. 2, 2011

(65) Prior Publication Data

US 2011/0185867 A1 Aug. 4, 2011

Related U.S. Application Data

(60) Provisional application No. 61/301,135, filed on Feb. 3, 2010.

(51) Int. Cl.
*B26F 3/00* (2006.01)
*E04G 23/08* (2006.01)

(52) U.S. Cl.
CPC .. *B26F 3/00* (2013.01); *E04G 23/08* (2013.01)
USPC ..... 299/17; 299/16; 299/29; 83/53; 83/177

(58) Field of Classification Search
CPC ..... E21C 25/60; E01C 23/128; E04G 23/08; E04G 3/22
USPC ..... 299/16, 17, 29, 30, 34.08, 53; 182/36, 182/37, 142; 83/53, 177; 239/159, 172, 251
See application file for complete search history.

(56) References Cited

U.S. PATENT DOCUMENTS

| | | | | |
|---|---|---|---|---|
| 3,809,318 | A | 5/1974 | Yamamoto | |
| 3,857,516 | A | 12/1974 | Taylor | |
| 4,045,086 | A | 8/1977 | Parkes | |
| 4,074,792 | A * | 2/1978 | Zaugg et al. | 182/150 |
| 4,074,858 | A | 2/1978 | Burns | |
| 4,081,200 | A | 3/1978 | Cheung | |
| 4,111,490 | A | 9/1978 | Liesveld | |
| 4,436,694 | A * | 3/1984 | Vassalotti et al. | 376/310 |
| 4,470,952 | A | 9/1984 | Vassalotti | |
| 4,646,769 | A | 3/1987 | O'Brien | |
| 4,795,217 | A | 1/1989 | Hilaris | |

(Continued)

FOREIGN PATENT DOCUMENTS

| | | | |
|---|---|---|---|
| DE | 25 26 323 | * 12/1976 | C12C 1/04 |
| JP | 2005024191 | 1/2005 | |
| WO | WO 2006/045198 | 5/2006 | |

*Primary Examiner* — John Kreck
*Assistant Examiner* — Carib Oquendo
(74) *Attorney, Agent, or Firm* — Smiths IP

(57) ABSTRACT

The subject matter of the invention disclosed herein is a hydro-demolition device and a top-down method for deconstructing structural surfaces. The device includes a rigid support frame mounted above a work-face on the structural surface being deconstructed. The rigid frame supports a cutting nozzles that move up and down along the structural surface. The nozzles may be mounted on a carriage that is movably connected to the rigid frame. The carriage may swing about a swing axis so that the nozzles move axially toward and away from the carriage. The nozzles may be movable toward and away from the work-face. The various movements of the nozzles are effectuated by rotators and drivers.

12 Claims, 6 Drawing Sheets

(56) References Cited

U.S. PATENT DOCUMENTS

| | | | |
|---|---|---|---|
| 4,813,313 | A | 3/1989 | Ichikawa |
| 4,854,770 | A | 8/1989 | Puchala |
| 5,010,694 | A | 4/1991 | Agbede |
| 5,020,183 | A | 6/1991 | Grant |
| 5,022,927 | A | 6/1991 | Seidel |
| 5,255,959 | A | 10/1993 | Logeal |
| 5,765,924 | A | 6/1998 | Liesveld |
| 6,050,277 | A | 4/2000 | Purton |
| 6,179,519 | B1 | 1/2001 | Hilmersson |
| 6,877,930 | B2 | 4/2005 | Stromdahl |
| 2001/0000003 | A1 | 3/2001 | Cope |
| 2005/0077775 | A1 | 4/2005 | Nakakuro |
| 2006/0087168 | A1 | 4/2006 | MacNeil |
| 2008/0041015 | A1 | 2/2008 | MacNeil |
| 2010/0140444 | A1 | 6/2010 | MacNeil |
| 2010/0206333 | A1 | 8/2010 | MacNeil |

* cited by examiner

TOP-DOWN HYDRO-DEMOLITION SYSTEM WITH RIGID SUPPORT FRAME

PRIORITY CLAIM

Pursuant to 35 U.S.C. §119, we claim priority benefits of U.S. provisional patent application 61/301,135 filed by Gerard J MacNeil et al. on Feb. 3, 2010.

FIELD OF THE INVENTION

The field of the invention is hydro-demolition devices and methods for cutting openings into structural surfaces.

BACKGROUND

Hydraulic demolition, also known as hydro-demolition, is a well-known art practiced by forcing an erosive material, generally a liquid such as water, through nozzles at sufficiently high pressure to produce a jet stream that disintegrates the materials of which buildings and structures are made thereby deconstructing the structural surface.

The term "structural surface" as used herein includes vertical walls, angled walls, curved walls, and any type of structural surface regardless of orientation or function that is amenable to having an opening cut therein by the apparatus and method disclosed below.

The terms "cut," "cutting," and "deconstructing" are used interchangeably herein to refer to the use of hydro-demolition technology to remove constituent material from a structural surface.

"Work-face" is used herein to refer to the area of a structural surface that is to be deconstructed.

The noun "opening" is used herein to refer to a hole that is cut into a structural surface, including a hole that does not completely penetrate the surface. The term "sides" when used without a modifier refers to the interior surfaces of such an opening, including the top, bottom, and lateral sides of the interior of the opening.

Hydro-demolition technology is often employed to cut openings in walls and other substantially vertical surfaces, and a number of hydro-demolition machines and techniques have been developed for these purposes.

In the art is it is well known to mount hydro-demolition devices on vehicles or platforms that are positioned on the ground. Generally, a lift-mechanism must be provided that is mounted on the ground, either directly or on a platform, and raises the cutting nozzles to the appropriate height to reach the work-face. This approach in which hydro-demolition equipment is supported by the ground is referred to herein as "bottom-up" hydro-demolition.

There are at least two significant problems with such a bottom-up approach to deconstructing structures with hydro-demolition equipment. First, it is necessary to have the machinery and, possibly, workmen, beneath the work-face. Because debris, eroded material, and water all fall downwards from the work-face under the force of gravity, the machinery and people working below the work-face can become soaked, coated with debris, and/or injured by the falling materials. The second significant problem is that there are limits as to how high such hydro-demolition devices can lift the nozzles. When working with very tall structures, a bottom-up approach to hydro-demolition is often not possible because the work-face is at a height that a cherry-picker or other lift-means cannot reach, or if they can, the resulting high center of gravity renders the equipment so unstable as to cause a hazard to workers.

For instance, in the field of nuclear reactors it is periodically necessary to deconstruct large areas from the reactor walls in order to make repairs to the walls or to structures embedded within the walls, such as tensioning tendons. As dozens of nuclear reactors approach and pass their life expectancy, it is also becoming commonplace to remove large pieces of equipment such as generators from the interior of the reactor for maintenance or replacement. In order to do this, it is often more economical to cut an opening in the wall of the reactor and remove the equipment through the opening rather than disassemble the equipment and take it out piece by piece through an existing "door," so to speak. Given the thickness and structural complexity of reactor walls, and given the substantial heights above the ground at which the openings have to be cut, deconstructing such large structures presents formidable challenges that cannot be overcome effectively with existing hydro-demolition technology.

Complicating these problems is the fact that the structural surfaces of reactors are often three or more feet thick. Thus, the cutting nozzle must be able to advance a number of feet into an opening that may be hundreds of feet off of the ground.

Conventional "cherry-picker" and crane type devices do not suffice for these jobs; besides, they are dangerous because they require workers to be at or near the base of the wall while it is being deconstructed.

The present invention resolves the problem of how to carry out hydro-demolition deconstruction on very tall structural surfaces such as the walls of large nuclear reactors and tall buildings. In short, we have discovered a method and device for effectuating a top-down approach using a rigid support frame that obviates many problems that are unavoidable when working from the ground up. The device can be successfully employed and the method successfully practiced on structural surfaces of virtually any height.

SUMMARY OF THE INVENTION

The invention may be most precisely disclosed, defined, and claimed with reference to the motions and/or orientations of its various movable elements. For reasons of clarity, the term "axial" is restricted herein to movement about or around an axis, and does not include movement along an axis. The term "rectilinear" is used to denote linear movement of an element, including movement along or parallel to a linear axis. The term "rotator" is used to mean a device or mechanism that produces axial movement of an element, assembly, sub-assembly, or component-group. The term "driver" is used to mean a device or mechanism that produces rectilinear movement of an element, assembly, sub-assembly or component-group. The terms "rotator" and "driver" are understood to include components such as energy sources, motors, hydraulic pumps, belts, chains, worm gears and the like that are necessary to accomplish the desired movement. Many of such components and sub-components of the invention, including drivers and rotators, are well known in the art of hydro-demolition, and one of skill in the art, after referring to this disclosure, will be able to choose and employ the appropriate elements in order to assemble and operate the invention without undue experimentation.

The invention includes a hydro-demolition device that employs a top-down approach to gaining access to a work-face by mounting a rigid support frame for hydro-demolition nozzles above the work-face rather than mounting a support structure below the work-face.

The invention may be summarized, at least in part, by the following enumerated statements.

Statement 1. The invention includes a hydro-demolition device for deconstructing a wall at a work-fac, wherein the hydro-demolition device comprises a rigid support frame. The rigid support frame comprises a top member mounted above the work-face and at least one rigid rail member extending substantially downward from the top member. The rail member comprises at least one rail. The hydro-demolition device also comprises a carriage, wherein the carriage is connected to the rail member in a manner that permits the carriage to move up and down along the rail. The hydro-demolition device also has a driver adapted to move the carriage up and down along the rail member. The hydro-demolition device also includes at least one nozzle, wherein the nozzle is carried up and down along the rail member by the carriage.

Statement 2. The invention includes the hydro-demolition device described in Statement 1, and further includes a mounting means for mounting the top member above the work-face.

Statement 3. The invention includes the hydro-demolition device described in Statement 2, wherein the mounting means includes a car, wherein the top member is mounted on the car, and wherein the car is positioned above the work-face.

Statement 4. The invention includes the hydro-demolition device described in Statement 2, wherein the mounting means comprises at least one beam disposed substantially horizontally from the wall, wherein the top member is mounted on the beam.

Statement 5. The invention includes the hydro-demolition device described in Statement 1, wherein the top member comprises a stub-leg and wherein the rail member is connected to the stub-leg.

Statement 6. The invention includes the hydro-demolition device described in Statement 1, wherein the rail member comprises at least two rail assemblies concatenated to form the rail member.

Statement 7. The invention includes the hydro-demolition device described in Statement 1, wherein the rail member is reversibly connected to the top member.

Statement eight. The invention includes the hydro-demolition device described in Statement 1, further comprising a nozzle carrier movably attached to the carriage, wherein the nozzle is carried back and forth along the carriage by the nozzle carrier.

Statement 9. The invention includes the hydro-demolition device described in Statement 8, further comprising an extension/retraction mechanism, wherein the nozzle is carried toward and away from the wall by the extension/retraction mechanism.

Statement 10. The invention includes the hydro-demolition device described in Statement 1, further comprising an extension/retraction mechanism, wherein the nozzle is carried toward and away from the wall by the extension/retraction mechanism.

Statement 11. The invention includes the hydro-demolition device described in Statement 8, further comprising swing means for swinging the nozzle carrier about a swing axis that is orthogonal to the wall.

Statement 12. The invention includes the hydro-demolition device described in Statement 11, wherein the swing means comprises 1) a hinge between the nozzle carrier and the carriage; and, 2) a carrier rotator, wherein the swing axis is through the hinge.

Statement 13. The invention includes the hydro-demolition device described in Statement 1, wherein the vertical driver comprises: 1) at least one motor; 2) at least one axle, wherein the motor turns the axle; and, 3) at least one sprocket and chain combination that is driven by the turning of the axle, wherein the carriage is connected to the chain and is moved upwards or downwards by the sprocket and chain.

Statement 14. The invention includes the hydro-demolition device described in Statement 1, wherein the vertical driver includes at least one of: a chain and sprocket, a rotating shaft, a belt and pulley, a worm gear, a rack and pinion, and a hydraulic ram.

Statement 15. The invention includes a method of using the hydro-demolition device described in Statement 1 to deconstruct a wall, the method comprising the steps of: (a) mounting the hydro-demolition device on the wall above a work face area that is to be deconstructed so that the rail member extends downward to the work-face; (b) moving the carriage up or down along the rail member until the carriage is at a desired position adjacent the work-face; (c) orienting the nozzle at a desired angle and a desired distance from the work-face; and, (d) applying a fluid to the nozzle at a sufficiently high pressure to deconstruct the wall.

Statement 16. The invention includes a method of deconstructing a wall using a hydro-demolition device having a rigid support frame, wherein the method comprises the steps of: (a) mounting the rigid support frame on the wall above a work-face that is to be deconstructed so that a rigid rail member of the rigid support frame extends downward toward the work-face; (b) moving a carriage up or down along the rigid rail member until the carriage is at a desired position adjacent the work-face, wherein at least one nozzle is carried on the carriage; (c) orienting the nozzle a desired angle and a desired distance from the wall; and, (d) applying a fluid to the nozzle at a sufficiently high pressure to deconstruct the wall.

BRIEF DESCRIPTION OF THE DRAWINGS

In the figures, elements and components are not necessarily drawn to scale. Where there is a plurality of essentially identical elements, normally only one is labeled with a reference numeral.

DETAILED DESCRIPTION OF THE INVENTION

The present invention relates to a novel hydro-demolition system for carrying out hydro-demolition, scarifying, and surface cleaning, particularly on tall structural surfaces. Of particular interest in employing the invention is the cutting of holes, windows, indentations, etc., referred to generically herein as "openings," in walls and other vertical structures, wherein the openings must be cut at such substantial heights off the ground that conventional hydro-demolition devices and methods cannot be easily employed.

Figure 1:
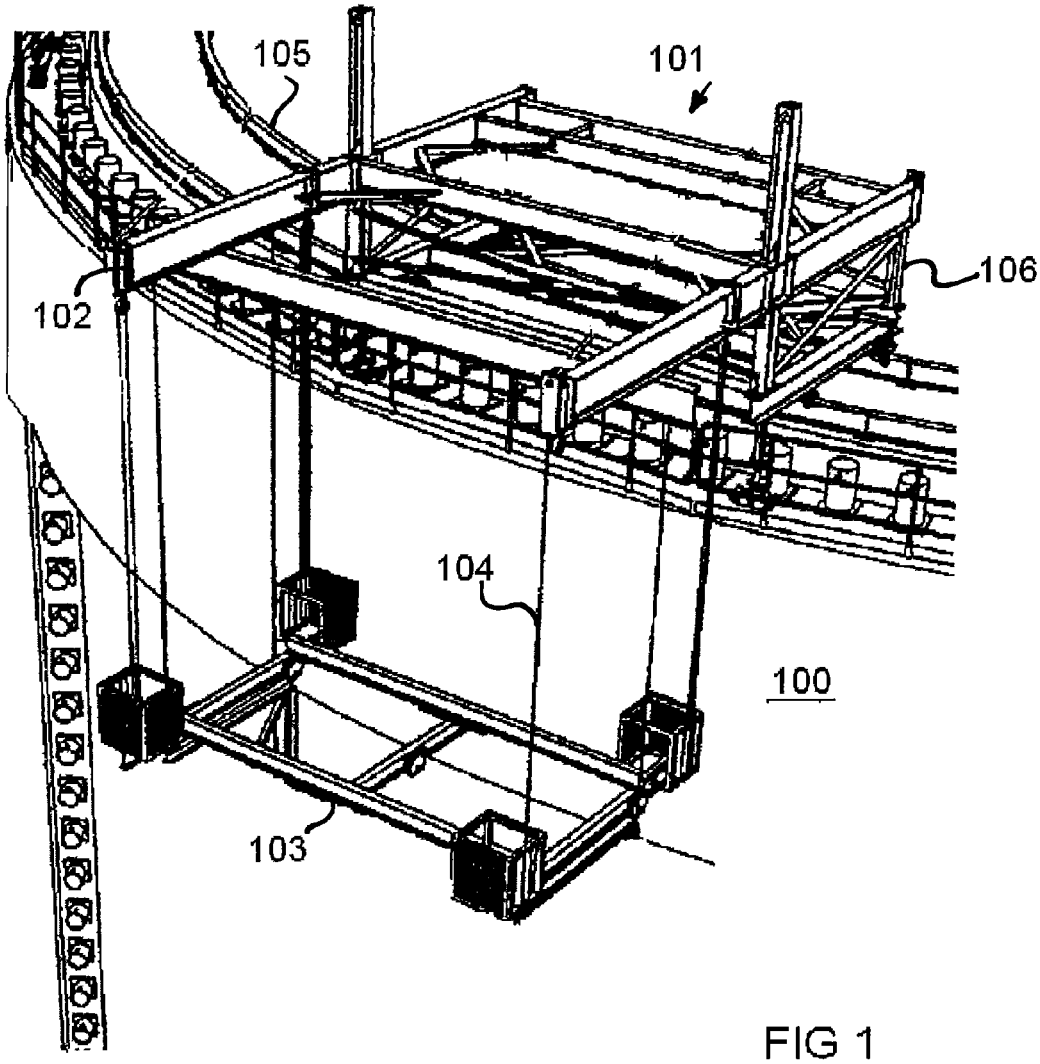
FIG 1 Prior Art
FIG. 1 is a perspective view of existing means for lowering workers to a work-face using non-rigid cables.

In order to place the cutting nozzles of the invention at such substantial heights, the support frame is mounted from above the work-face and the cutting equipment is lowered to the level of the work-face. Optionally, mounting the invention may be done by exploiting existing prior art devices that are used to suspend worker-platforms from the top of structural surfaces. One example of such prior art devices is shown in FIG. 1. In this example, a curved wall 100 of a nuclear reactor is the structure being worked on. The reactor has a movable support member 101 that includes a moveable car 106 that rides on tracks 105 that run along the edge of the top of the reactor wall. Although the invention works well and adequately with a fixed support rather than a movable car, in our preferred embodiment a car such as that shown in FIG. 1 is employed in order to exploit the full potential of the invention.

The prior art movable car 106 has horizontally disposed beams 102 that extend over the edge of the top. From these beams is suspended a platform 103. FIG. 1 shows just the floor-frame of such a platform. The platform may be, for instance, a cage from which workers can do maintenance on the wall. The platform 103 is suspended from the beams 102 by means of cables 104 so that it can be raised and lowered, for instance by winding the cables onto drums.

Whilst it would be possible to simply mount hydro-demolition nozzles on such an existing platform and lower the platform down the wall, we have discovered that such an arrangement has numerous disadvantages that make it unworkable in many situations. For instance, suspending the platform with cables presents problems because of the forces produced by the water jets during hydro-demolition force the platform away from the wall. In addition, in many instances the tolerances for the openings made in the wall are so tight that excess motion of a platform suspended by cables reduces the required precision to an unsatisfactory level. As will be appreciated by referring to FIGS. 2-7, the present invention overcomes these difficulties by providing a rigid frame upon which the cutting nozzles are mounted and with which hydro-demolition services can be preformed remotely.

Figure 2:
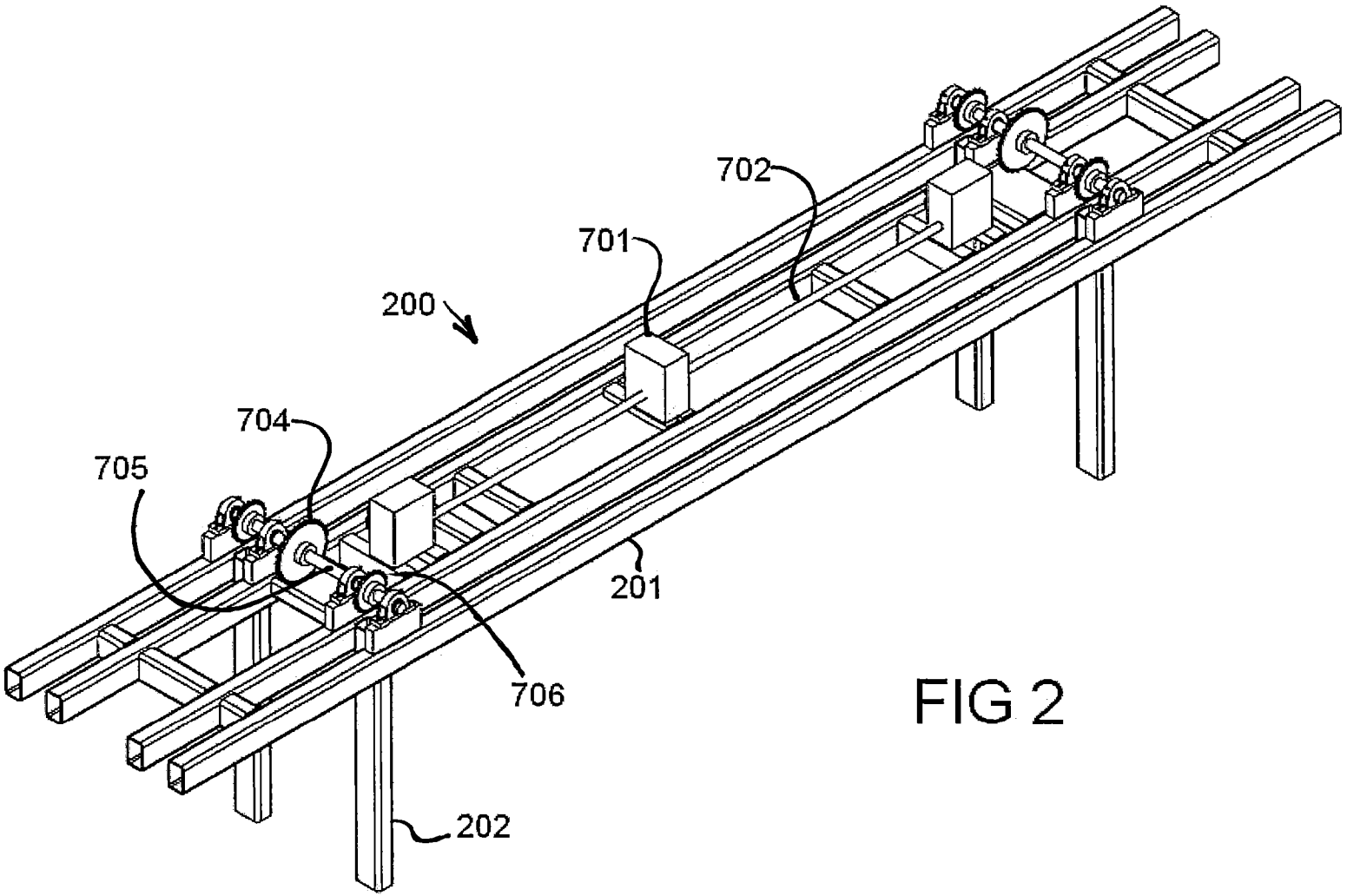
FIG. 2 is a perspective view of a top member of the rigid frame of one embodiment of the invention.
Figure 3:
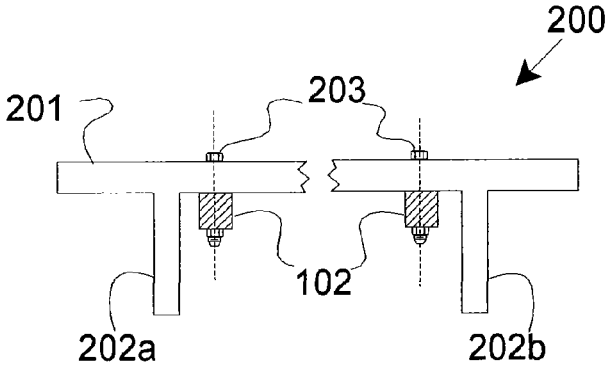
FIG. 3 is a plan view of the top member of FIG. 2 mounted to a supporting structure.

FIG. 2 is a perspective view of a top member 200 component of the rigid frame of the invention. The top member includes a horizontal support frame 201. A means for mounting the top member is provided. For instance, the beams 102 of movable car 106 (See FIG. 1) may be used as shown in FIG. 3. The support frame 201 is set down on the beams and secured. A reversible connection to hold the support frame on the beams is preferred. This can be conveniently done as shown in FIG. 3, which is a side view of the top member 200 looking toward the ends of the beams 102 oriented as in FIG. 1. The support frame 201 is set down on the beams 102 and then secured to the beams, for instance, with bolts 203, U-bolts, or other suitable connection means. Other mounting means for mounting the device on the wall includes mounting directly to the wall by having beams upon which the frame rests attached directly to the wall or integrated into the wall and projecting therefrom, for instance. The mounting means may be a lip, or ledge at the top of the wall or projecting from the surface of the wall. Any structure that is sufficiently strong to hold the hydro-demolition device and that allows the support frame 201 to be oriented substantially horizontally above the work-face may be considered means for mounting the top member to the wall.

The preferred embodiment of the invention includes a means for attaching a vertical rail assembly to support frame 201. This rail assembly attachment means may include a number of structures such as bolts, welds, and the like. In a preferred embodiment, the support frame 201 has stub-legs 202*a/b* as shown in FIGS. 2 and 3. Each one of 202*a* and 202*b* of FIG. 3 may represent a single stub-leg-structure or a plurality of stub-legs; the number of stub-legs required will be determined by parameters dictated by each job. Our current preference is to weld two sets of two stub-legs to the under-surface of the horizontal support frame 201 so that the stub-legs and support frame form a solid, integrated unit, as shown in FIG. 2. However, depending on how and where the invention is being used, it may be preferable or necessary to reversibly attach the stub-legs using threaded members, bolts, and the like.

Figure 4:
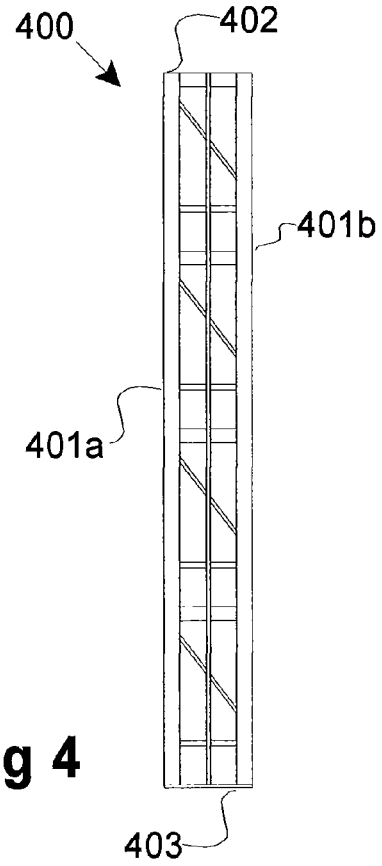
FIG. 4 is a plan view of a rigid rail assembly of one embodiment of the invention.

One aspect of the invention is a rigid means for carrying a platform, car, carriage, or other structure, referred herein generically as "carriage," up and down along the surface of the structure. This means may include a rigid rail-assembly 400 as shown in FIG. 4. The rail assembly of FIG. 4 is shown in a somewhat rudimentary form in order to facilitate comprehension.

The two rails of the preferred embodiment are nominated here as a front or first rail 401*a*, and a back or rear rail 401*b*, wherein "front" and "back" mean toward and away from the structural surface, respectively. These two rails are connected together by means of cross-struts and supports to form a rail assembly 400. Each rail assembly has a top 402 and a bottom 403.

Various approaches to stiffening and reinforcing the rail assembly will be obvious to those of skill in the art having read this disclosure. Although it is our current preference to provide two such rail assemblies, each assembly having two rails as described below, the invention could be practiced with any number of rails that support nozzles or a carriage.

Each of the two rail assemblies is attached to the horizontal support frame 201 by attaching the top 402 of the rail assembly 400 to the bottom of stub-legs 202*a*. In this way the rail assemblies are attached to and extend vertically beneath the top member, approximately perpendicular to the long axis of the support frame 201 when the device is mounted on the wall, as discussed below.

Depending on the size and the scope of the project and the lengths of the individual rail assemblies, it is often necessary to concatenate a plurality of rail assemblies end to end. In this way multiple rail assemblies are interconnected to produce a rigid rail member that extends downward a desired distance from the top of the structure. The term "rail member" is used herein to refer to a linear arrangement of one or more rail assemblies. Where only one rail assembly is required for a job, the rail member comprises just that assembly.

If, for instance, it is necessary to cut an opening in a wall that is 100 feet high, and the required opening is to be 10 feet high and have an upper edge 20 feet below the upper edge of the wall, then the desired length of the rail members will be on the order of at least 30 feet, requiring, for example, two 15-foot rail assemblies connected to form each rail member. The point is to provide two sufficiently long rail members connected to the top member, reaching at least to the bottom of the work-face and lying in a plane approximately parallel to the structural surface.

Of course, not all structural surfaces are perfectly vertical and some, such as reactor walls, may be curved; consequently, in some instances one or both rail assemblies may not lie precisely in a plane that is parallel to the structural surface. In the case of curved surfaces, it is possible to provide a support frame and/or carriage having complimentary curvatures to the wall in order to maintain the rail assemblies a proper and consistent distance from the surface.

Figure 5:
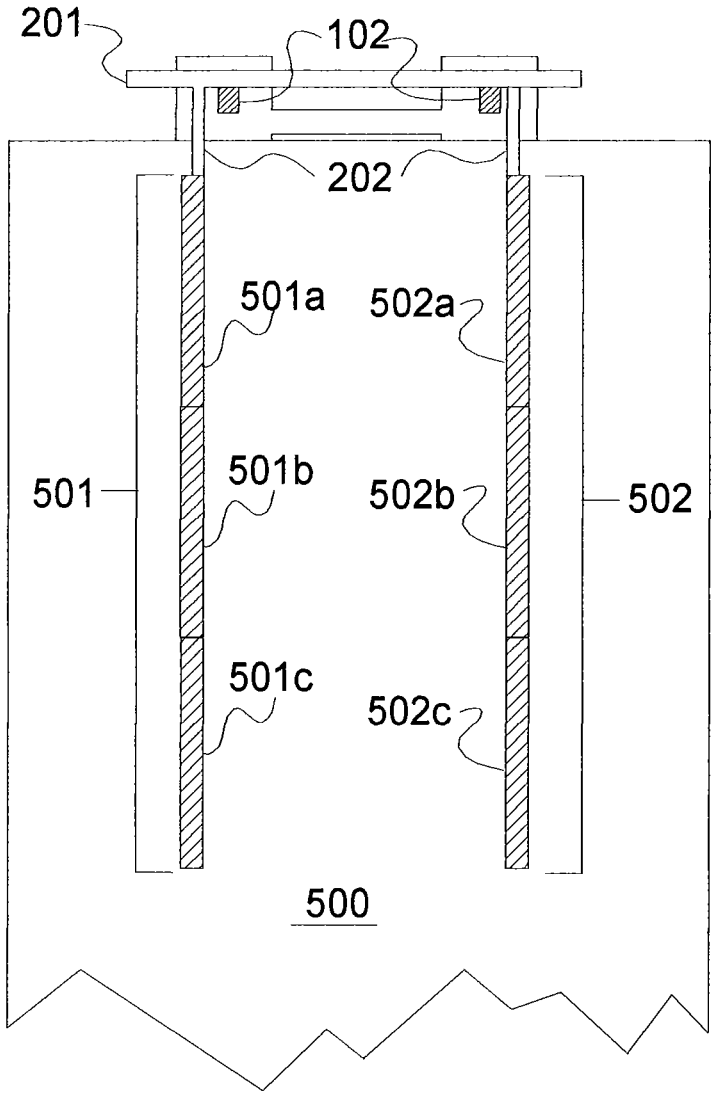
FIG. 5 is a plan view of one a rigid frame of one embodiment of the invention mounted on a structural surface.

FIG. 5 is a plan view showing rigid support frame according to one embodiment of the invention mounted to a structural surface 500 that is to be worked on. There are two vertically oriented rail members 501/502, each of which is made up of three rail assemblies 501*a-c* and 502*a-c*. For example, the top of rail assembly 501*c* is connected to the bottom of rail assembly 501*b*, and the top of 501*b* is connected to the bottom of rail assembly 501*a* to form vertical rail member 501. The top of each rail member is attached to a stub-leg 202, which stub-legs are a part of or connected to the support frame 201. The entire interconnected structure is supported by beams 102 of the movable car 106 or other support component attached to or near the top of the wall (See FIG. 1).

In summary, the component-groups of the rigid support structure of this preferred embodiment include 1) the top member 200 with its support frame 201 and stub-legs 102, and 2) the attached rail members 501/502 that are made up of one or more rail assemblies. This support structure supports a movable carriage such as the one shown in perspective in FIG. 6.

Figure 6:
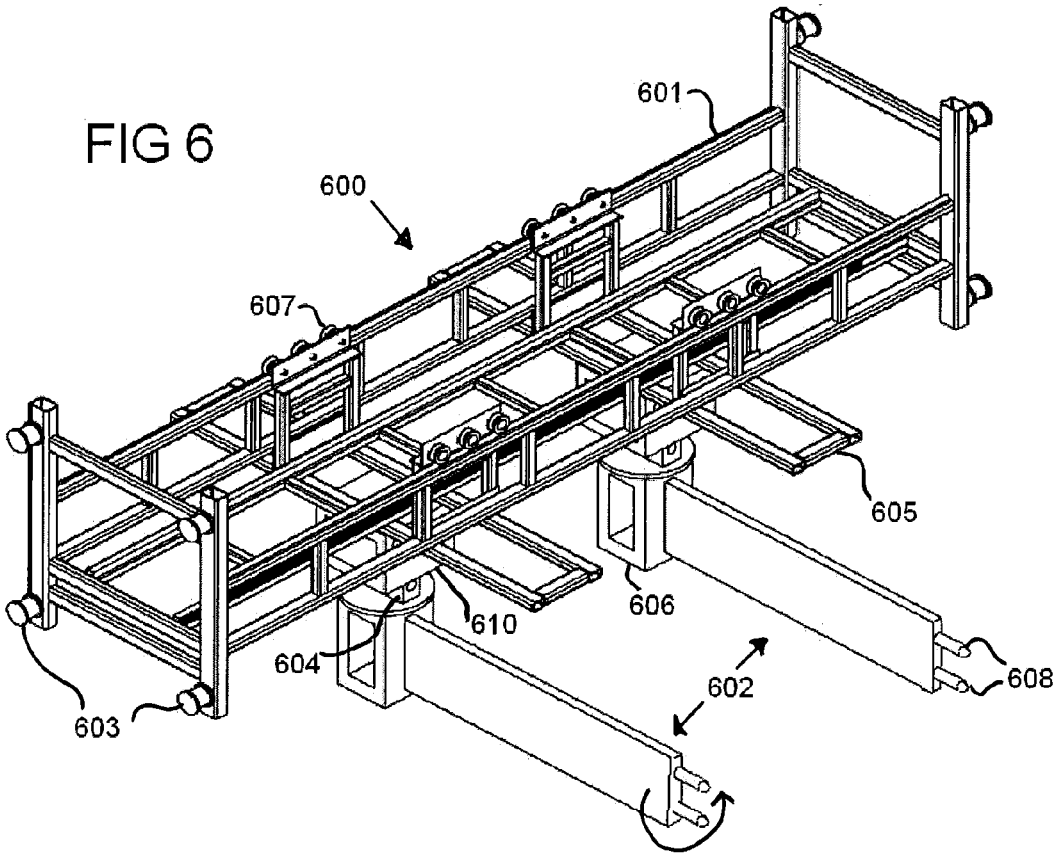
FIG. 6 is a perspective view of a carriage and two nozzle assemblies according to one embodiment of the invention.

The carriage 600 may be a generally rectangular frame 601 that is connected to the vertical rail members. A driver drives the carriage up and down the rails. The function of the carriage is to carry nozzles that direct jets of high pressure fluid against the surface of the structure. The nozzles may be directly connected to the carriage; however, in the preferred embodiment the nozzles are connected to a nozzle carrier 606, which is attached to the carriage 600. The nozzle carrier with its respective nozzles and mechanism(s) for moving the nozzles, whether or not they are arranged as cannon, is conveniently referred to as a "nozzle assembly." One or more nozzles together with the nozzle carrier may form a collective structure referred to herein as a "water cannon" or simply "cannon." A pair of water cannon 602 is shown in FIG. 6. Nozzles 608 are located at the ends of the elongate arms of the cannon.

With reference to FIGS. 4 and 6, a means for movably attaching the carriage to the rail members is provided in the form of a plurality of rail guides 603 attached to the ends of the carriage 600, which rail guides engage the front and rear rails 401*a,b* of the rail members so that the carriage rides up and down the rail members.

Drivers for moving the nozzles, or cannon in the present embodiment, orthogonally with respect to the longitudinal axis of the carriage are provided. For instance, nozzle carriers 606 are carried to and fro on tracks 605 by trolleys 610. The tracks are oriented substantially orthogonally to the longitudinal axis of the carriage and also substantially orthogonally to the surface of the wall. The nozzle carriers move rectilinearly along the tracks, toward and away from the wall, thereby moving the cannon closer to and farther from the work-face. In the perspective drawing of FIG. 6 the wall would be toward the right-hand side of the figure, with cannon 602 pointing toward it. Hydraulic rams (not shown) are our preferred extension/retraction drivers for driving the nozzle carriers along tracks 605 toward and away from the wall. Hence, the carriers, tracks, and extension/retraction drivers form an extension/retraction mechanism for moving the nozzles toward and away from the work-face.

The nozzle assembly is also movable back and forth along the length of the carriage. When there are more than one such nozzle assemblies, as shown in FIG. 6, preferably they move in tandem. The movement of each nozzle assembly along the carriage is facilitated by a plurality of wheels or rollers 607. A driver (not shown) is provided to produce this movement; for instance, one or more hydraulic or electric motors may be used as the driver. Of course, one of skill in the art will recognize that there are many ways to produce the various movements of the components of the invention. Disclosed here are merely our currently preferred embodiments, which is to say, the best mode known to us.

Referring to FIG. 6 yet again, a swing means is provided for axially swinging the nozzle carrier about a swing axis that is substantially orthogonal to the surface of the wall. A number of mechanisms can be employed to implement this feature. For instance, a rotator in combination with ball and socket joints, swivel joints, or hinges can be used. Our preference is a carrier rotator (not shown) attached to each nozzle carrier 606 to cause the nozzle carrier to swing 90 degrees on a carrier hinge 604 about the swing axis, where the swing axis is through the hinge, substantially coincidental with the hinge-pin and substantially orthogonal to the work-face. This swinging motion is indicated for just the left-most cannon by the curved arrow of FIG. 6, although both cannon may swing in this manner. By swinging the nozzle carrier upwards toward the bottom of carriage 600, the nozzles 608 become oriented horizontally rather than vertically (as they are in FIG. 6) so that the nozzles are lined up along a line that is substantially parallel to the long axis of the carriage 600. This feature for swinging nozzles provides greater cutting precision and easier access to the interior of the hole, particularly as the carriage nears the upper rim of the wall where further upward movement is not possible. Our preference for the carrier rotator is a small hydraulic ram that connects the top edge of the nozzle carrier 606 to the trolley 610 attached to the bottom of the track 605. Extension and retraction of the ram cause the carrier to swing about the axis through the hinge. Other approaches include electric motors, hydraulic motors, servo-mechanisms and the like. Thus, the carrier, the cannon, and the nozzles form a multi-axis sub-assembly that moves back and forth along the long axis of the carriage, moves toward and away from the work-face, and swings axially 90° about an axis that is orthogonal to the work-face.

Thus, the nozzles can move toward and away from the wall along the tracks 605, they can move to and fro across the structural surface by moving along the carriage, and the can also swing 90° about a swing axis that is substantially orthogonal to the structural surface.

Figure 7:
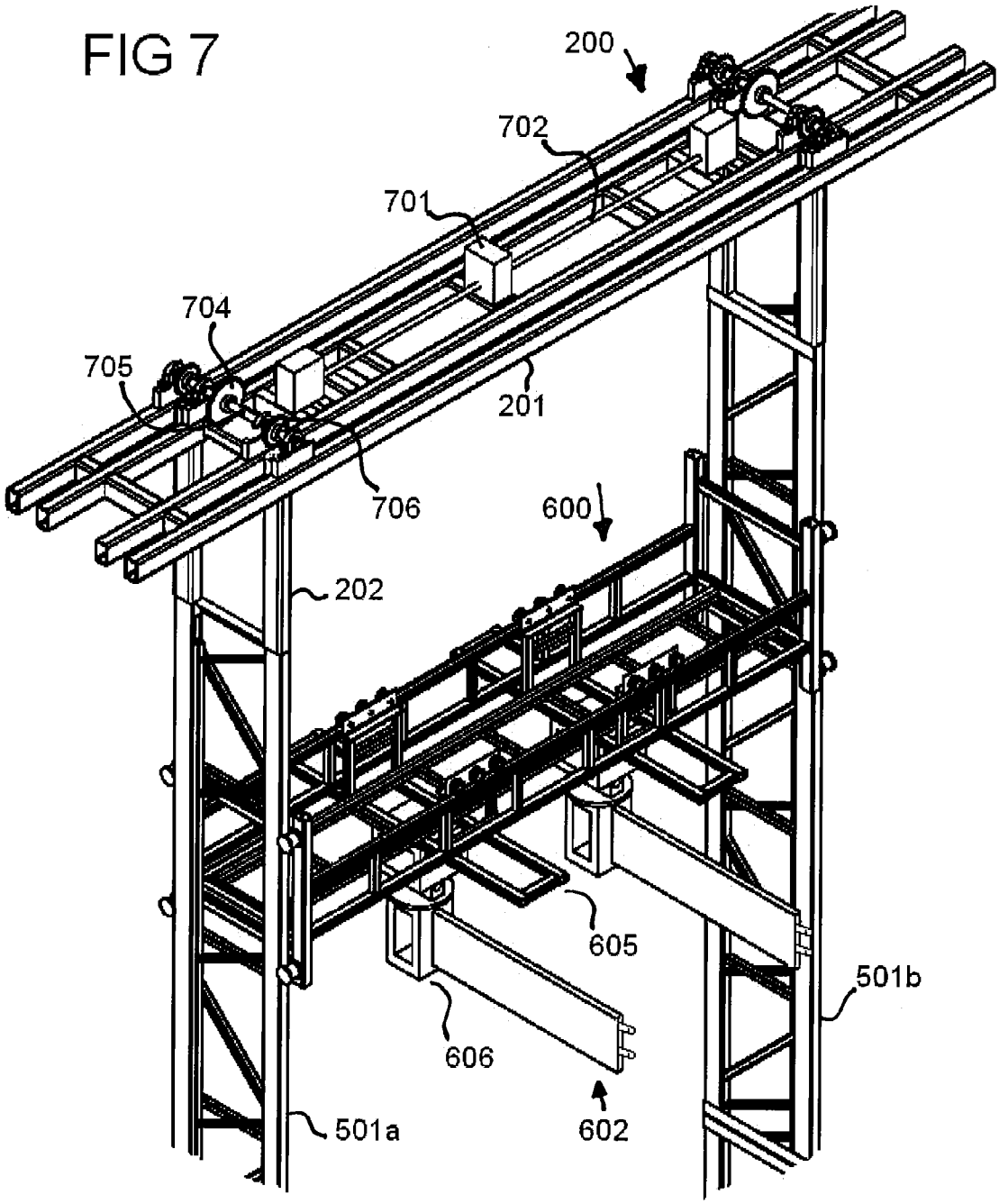
FIG. 7 is a perspective view of a rigid support frame, carriage, and nozzle assemblies of one embodiment of the invention.

FIG. 7 shows assembly of the foregoing major component-groups of the preferred embodiment of the invention. Top member 200 is shown with its horizontally disposed support frame 201 and its stub-legs 202. Attached to each stub-leg is a rail member, 501*a,b* comprising rail assemblies. Carriage 600 is mounted on the rail members so that the carriage can move up and down the rails. The wall or other structural surface being worked on is not shown in FIG. 7 but would be positioned to the right of the drawing with the cannon 602 pointing toward it. The cannon are connected to the carriage by means of the nozzle carriers 606. The entire hydro-demolition assembly rests on and is connected to the beams 102. (See FIG. 1.) High pressure water is supplied to the cannon from a remote source by means of high pressure hoses, which are not shown.

FIG. 7 in conjunction with FIG. 2 shows our preferred driver mechanism for raising and lowering of the carriage on the vertical rails. A number of mechanisms will be obvious to those of skill in the art as being adaptable to function as such a driver. Chain and sprocket drives, rotating shafts, belt and pulley drives, worm gears, rack and pinion drives, and hydraulic rams are well-known examples of possible driver mechanisms. We prefer to use a hydraulic drive motor 701 that turns one or more axles 702. The axles drive primary sprocket/chain combinations 704 that are located on cross-axles 705. Near the ends of the cross-axles are secondary sprocket/chains 706. The secondary chains are heavy-duty chains (not shown) that movie within the rail members and that movably supports the carriage such that the rotation of the secondary sprockets causes the carriage to move up and down along the rails. Currently we prefer a single drive motor 701 to drive two axles 702, two primary sprocket/chain combinations 704, and four secondary sprockets/chains 706.

The carriage may be attached to the rigid support frame before or after the frame is mounted above the work-face. The carriage is positioned at the appropriate height of the wall by moving it up and down the rail members with the vertical driver. Cannon 602 move back and forth along the length of the carriage and are put into position adjacent the point at which the hydro-demolition is to begin. The cannon are moved toward or away from the wall until they are a desired distance from the wall to begin operation. High pressure fluid is applied to the nozzles, which produce jets of the fluid directed at the work-face. The cannon move back and forth across the wall by being driven to and fro along the carriage, thereby cutting a swath of the wall. As the surface is eroded, the cannon are moved toward the wall, cutting the swath deeper and deeper into the growing opening. When the final or a desired intermediate depth is reached for that swath, the cannon are backed out, the height of the carriage is again adjusted, and the process is repeated. If the invention is supported by a movable car at the top of the wall as described above, the entire apparatus shown in FIG. 7 can be repositioned horizontally along the wall by moving the movable car along its track at the top of the wall. This is the most efficient way to attack large areas of vertical surface.

It is to be emphasized that the vertical movements of the carriage, the movements of the cannon along the length of the carriage, the movement of the cannon toward and away from the work-face, and the high-pressure fluid in our preferred embodiment are all controlled remotely by means of remote control devices known in the art. Consequently, a worker does not ride on the carriage during the cutting operation and need not be put in the path of flying debris and fluid. Once the apparatus is in place, the hydro-demolition operation can be completely controlled from a safe distance by means of a remote console.

The invention has been described here with respect to a particular, preferred embodiment. Those of skill in the art will recognize that the scope of the invention obviously extends beyond this particular embodiment. While the component elements of the invention are well known, it is the novel and non-obvious arrangement of those elements that results in the unexpected features, functions, uses, and advantages of the invention.

What we claim is:

1. A top-down hydro-demolition device for deconstructing a wall at a work-face, wherein said hydro-demolition device comprises:

a. a horizontally elongated rigid support frame, wherein said rigid support frame comprises, a top member, wherein said top member is supported from the top of the wall above the work face;

b. two rigid rail members attached to and extending downwardly from said top member, said rail members being spaced from one another along said top member, each of said rail members comprising a rail extending vertically along said respective rail member;

c. a carriage extending horizontally between, and connected to, said two rail members in a manner that permits said carriage to move up and down along said rails;

d. a driver adapted to move said carriage up and down along said rails; and, e. at least one nozzle carried on said carriage, said nozzle being movable in relation to said carriage.

2. The hydro-demolition device according to claim 1, further comprising at least one beam extending substantially horizontally from the wall, wherein said top member is mounted on said at least one beam.

3. The hydro-demolition device according to claim 1, wherein said top member comprises at least two spaced stub-legs and wherein each of said rail members is connected to one of said stub-legs.

4. The hydro-demolition device according to claim 1, wherein each of said rail members comprises at least two concatenated rail assemblies.

5. The hydro-demolition device according to claim 1, wherein each of said rail members is reversibly connected to said top member.

6. The hydro-demolition device according to claim 1, further comprising a nozzle carrier movably attached to said carriage, wherein said nozzle is carried back and forth along said carriage by said nozzle carrier.

7. The hydrodemolition device according to claim 6, further comprising an extension/retraction mechanism, wherein said nozzle is carried toward and away from the wall by said extension/retraction mechanism.

8. The hydro-demolition device according to claim 1, further comprising an extension/retraction mechanism, wherein said nozzle is carried toward and away from the wall by said extension/retraction mechanism.

9. The hydro-demolition device according to claim 1, further comprising:

a. a hinge between said nozzle carrier and said carriage; and, b. a carrier rotator, wherein a swing axis is through the hinge.

10. The hydro-demolition device according to claim 1, wherein said vertical driver comprises:

a. at least one motor;

b. at least one axle, wherein said motor turns said axle; and, c. at least one sprocket and chain combination that is driven by the turning of said axle, wherein said carriage is connected to said chain and is moved upwards or downwards by said sprocket and chain.

11. The hydro-demolition device according to claim 1, wherein said vertical driver comprises at least one of: a chain and sprocket, a rotating shaft, a belt and pulley, a worm gear, a rack and pinion, and a hydraulic ram.

12. A method of using the hydro-demolition device of claim 1 to deconstruct a wall, said method comprising the steps of:

a. connecting a horizontally elongated rigid support frame to the wall above a work-face on the wall that is to be deconstructed so that a two spaced rigid rail members depending from said frame extends downward along the wall;

b. moving a horizontally extending carriage that spans said two rail members up or down along the rigid rail members until the carriage is at a desired position adjacent the work-face;

c. orienting a nozzle carried on said carriage at a desired angle and positioning said nozzle a desired distance from the wall; and, d. applying fluid to the nozzle at a sufficiently high pressure to deconstruct the wall.

* * * * *